US006986977B2

(12) United States Patent
Ishii et al.

(10) Patent No.: US 6,986,977 B2
(45) Date of Patent: Jan. 17, 2006

(54) IMAGE FORMING APPARATUS AND IMAGE FORMING METHOD

(75) Inventors: Koichi Ishii, Kanagawa-ken (JP); Yasushi Shinjo, Kanagawa-ken (JP); Mitsunaga Saito, Chiba-ken (JP); Haruhi Ooka, Kanagawa-ken (JP)

(73) Assignee: Kabushiki Kaisha Toshiba, Tokyo (JP)

( * ) Notice: Subject to any disclaimer, the term of this patent is extended or adjusted under 35 U.S.C. 154(b) by 168 days.

(21) Appl. No.: 10/391,624

(22) Filed: Mar. 20, 2003

(65) Prior Publication Data

US 2003/0211412 A1 Nov. 13, 2003

(30) Foreign Application Priority Data

Mar. 20, 2002 (JP) ..... 2002-077892

(51) Int. Cl.
*G03G 9/08* (2006.01)
*G03G 13/14* (2006.01)

(52) U.S. Cl. ..... 430/117; 430/126; 399/147; 399/237; 399/297; 399/308

(58) Field of Classification Search ..... 430/117, 430/126; 399/147, 237, 297, 308
See application file for complete search history.

(56) References Cited

U.S. PATENT DOCUMENTS 5,648,190 A * 7/1997 Kato et al. ..... 430/47
5,915,144 A 6/1999 Ide et al.
5,981,121 A 11/1999 Ide
6,217,694 B1 4/2001 Taniguchi

FOREIGN PATENT DOCUMENTS

| | | |
|---|---|---|
| JP | 5-281863 | 10/1993 |
| JP | 8-44216 | 2/1996 |
| JP | 10-67200 | 3/1998 |
| JP | 10-123863 | 5/1998 |
| JP | 11-7174 | 1/1999 |

* cited by examiner

*Primary Examiner*—Mark A. Chapman
(74) *Attorney, Agent, or Firm*—Oblon, Spivak, McClelland, Maier & Neustadt, P.C.

(57) ABSTRACT

An image forming apparatus of the present invention having a transferring particle layer forming equipment which forms a transferring particle layer prior to forming a toner layer on a surface of an image recording member, whose coagulation force among the transferring particles in the transferring particle layer is smaller than adhesive force of the transferring particle layer to the image recording member, a development equipment which forms a toner layer on a surface of the image recording member according to image information with a liquid developer in a manner that a part of the toner layer is superimposed on the transferring particle layer and a transfer equipment which transfer the toner layer to a transfer medium together with a part of the transferring particle layer. As a result, high transfer efficiency can be obtained, and an image forming apparatus which realizes high image quality is provided.

20 Claims, 8 Drawing Sheets

IMAGE FORMING APPARATUS AND IMAGE FORMING METHOD

CROSS-REFERENCE TO RELATED APPLICATIONS

This application is based upon and claims the benefit of priority from prior Japanese Patent Application No. 2002-077892 filed on Mar. 20, 2002, the entire contents of which are incorporated herein by reference.

BACKGROUND OF THE INVENTION

1. Field of the Invention

The present invention relates to an image forming apparatus and an image forming method, in which a liquid developer is used for producing a toner image on a transfer medium.

2. Description of the Related Art

An electrophotographic type image forming apparatus, which produces a developed image by using a liquid developer, has following advantages: extremely fine toner particles of sub-micron in diameter can be used so that a high quality image comparable to that of the offset printing is realized, copying cost is reduced because sufficient image density can be obtained with a small amount of toner, and energy saving is accomplished because the toner can be fixed to a copy sheet at a relatively low temperature. All of those advantages are not obtained with an electrophotographic recording apparatus using a dry developer.

As one method for transferring the toner image formed on a photosensitive member to a transfer medium in an image forming apparatus using a liquid developer, there is a pressure transfer method that transfers toner particles on a surface of a photosensitive member with the aid of adherence of toner particles by pressing the photosensitive member to the transfer medium. In the pressure transfer method, the toner particles are transferred from the surface of the photosensitive member to the transfer medium according as their surface energy and a shearing stress. The transferability of the toner particles from the surface of the photosensitive member to the transfer medium depends on the correlation of the surface energy between the toner particles and the surface of the photosensitive member and the shearing stress between the surface of the photosensitive member and the transfer medium.

The pressure transfer method has an advantage that a high quality image can be obtained because electric disturbance of the toner particles does not occur when transferring is carried out unlike a transfer method using an electric field. Particularly, the pressure transfer method has advantageous in transferring the toner image to the recording medium, such as copying paper under pressure via an intermediate transfer medium because of less transferring load and wide applicability of the recording media.

However, in the pressure transferring method, the intermediate transfer medium requires two antithetical properties that the toner image can easily be ripped off from the photosensitive member while the toner image can easily be transferred to the recording medium. Therefore, there is a less room to select a material for the intermediate transfer medium, and then the permissible zone for transferring becomes narrow.

Furthermore, even if the material for the intermediate transfer medium is selected as appropriate as possible, there has been a possibility of occurrence of inferior transfer particularly at the top edge portion of the image region where the toner image becomes thick, because deterioration of adherence between the toner image and the surface of the intermediate transfer medium takes place, which is caused by the different height between the image region and the non-image region.

To overcome this drawback, Japanese patent publication (Kokai) No. 08-44216 discloses a method wherein a transfer layer of transparent toner is pre-formed entirely on a photosensitive member so as to rip off the toner image easily from the photosensitive member, the transparent toner is then made into a film, thereafter the toner image is formed on the filmed transfer layer, and the toner image is transferred to a transfer material together with the filmed transfer layer. In this transfer method, a thermoplastic resin is employed as the transparent toner, and the transfer layer is made into a film by developing the transparent toner on the photosensitive layer in advance, and then the transfer layer is made into a film by heating and melting the transparent toner. After the toner image is formed on the transfer layer by a conventional electrophotographic process, the toner image is transferred together with the transfer layer by heating again the transfer layer at the transferring step.

However, the transfer method mentioned above has disadvantages in that the properties of the photosensitive member are affected and selection of the photosensitive material is limited, and more over lengthening the life duration of the photosensitive member is prevented, because the transfer method requires a heating process at the transparent toner film making process after the development of the transparent toner on the surface of the photosensitive member. Furthermore, in view of transfer energy, the transparent toner and the photosensitive material have a problem in that they have to be satisfied properties: the toner image and the transfer layer adhere closely together while the transfer layer and the photosensitive member separate easily from each other.

Consequently, it has been expected to realize an image forming apparatus having high transfer efficiency and long life duration of the photosensitive member, yet a high quality image can be obtained effectively, despite the materials of the intermediate transfer medium and the photosensitive member, when the pressure transfer method is adopted to obtain high quality transfer images.

BRIEF SUMMARY OF THE INVENTION

The object of the present invention is to provide an image forming apparatus and method having high transfer efficiency by using a pressure transfer method. The object of the present invention is also provide an image forming apparatus and method, which enables wide selection of materials for an intermediate transfer medium and a photosensitive member and achieves long life duration of the photosensitive member, while obtaining a high quality transfer image.

In accordance with an embodiment of the invention, an image forming apparatus has an image recording member, a transferring particle layer forming equipment which forms a transferring particle layer on a part of the image recording member, a development equipment which forms a toner layer with toner particles on a surface of the image recording member according to image information with a liquid developer containing the toner particles and a liquid carrier in a manner that a part of the toner layer is superimposed on the transferring particle layer; and a transfer equipment which transfer the toner layer to a transfer medium together with a part of the transferring particle layer, wherein coagulation force among the transferring particles in the transferring particle layer is smaller than adhesive force of the transferring particle layer to the image recording member.

Further, according to another embodiment of the present invention, an image forming apparatus comprising, an image recording member, a transferring particle layer forming equipment which forms a transferring particle layer on a part of the image recording member, a development equipment which forms a toner layer with toner particles on a surface of the image recording member according to image information with a liquid developer containing the toner particles and a liquid carrier in a manner that a part of the toner layer is superimposed on the transferring particle layer; and a transfer equipment which transfer the toner layer to a transfer medium together with a part of the transferring particle layer, wherein the transferring particles in the transferring particle layer on either the image recording member and the transferred toner layer remains approximately not less than 90% of the whole area thereof, respectively.

Further, according to another embodiment of the present invention, an image forming method comprising forming a transferring particle layer with transferring particles, whose coagulation force among themselves is smaller than adhesion force thereof to an image recording member, on a part of the image recording member, forming a toner layer with toner particles on a surface of the image recording member according as image information with a liquid developer containing the toner particles and a liquid carrier in a manner that a part of the toner layer is superimposed on the transferring particle layer; and transferring the toner layer formed on the surface of the image recording member to a transfer medium together with at a part of the transferring particle layer.

Further, according to another embodiment of the present invention, an image forming method comprising forming a transferring particle layer of transferring particles on at a part of an image recording member, forming a toner layer with toner particles on a surface of the image recording member according as image information with a liquid developer containing the toner particles and a liquid carrier in a manner that a part of the toner layer is superimposed on the transferring particle layer, and transferring the toner layer formed on the surface of the image recording member to a transfer medium together with at a part of the transferring particle layer, wherein the transferring particles in the transferring particle layer on either the image recording member and the transferred toner layer remains approximately not less than 90% of the whole area thereof, respectively when the transferring step has finished.

DETAILED DESCRIPTION OF THE INVENTION

Figure 1:
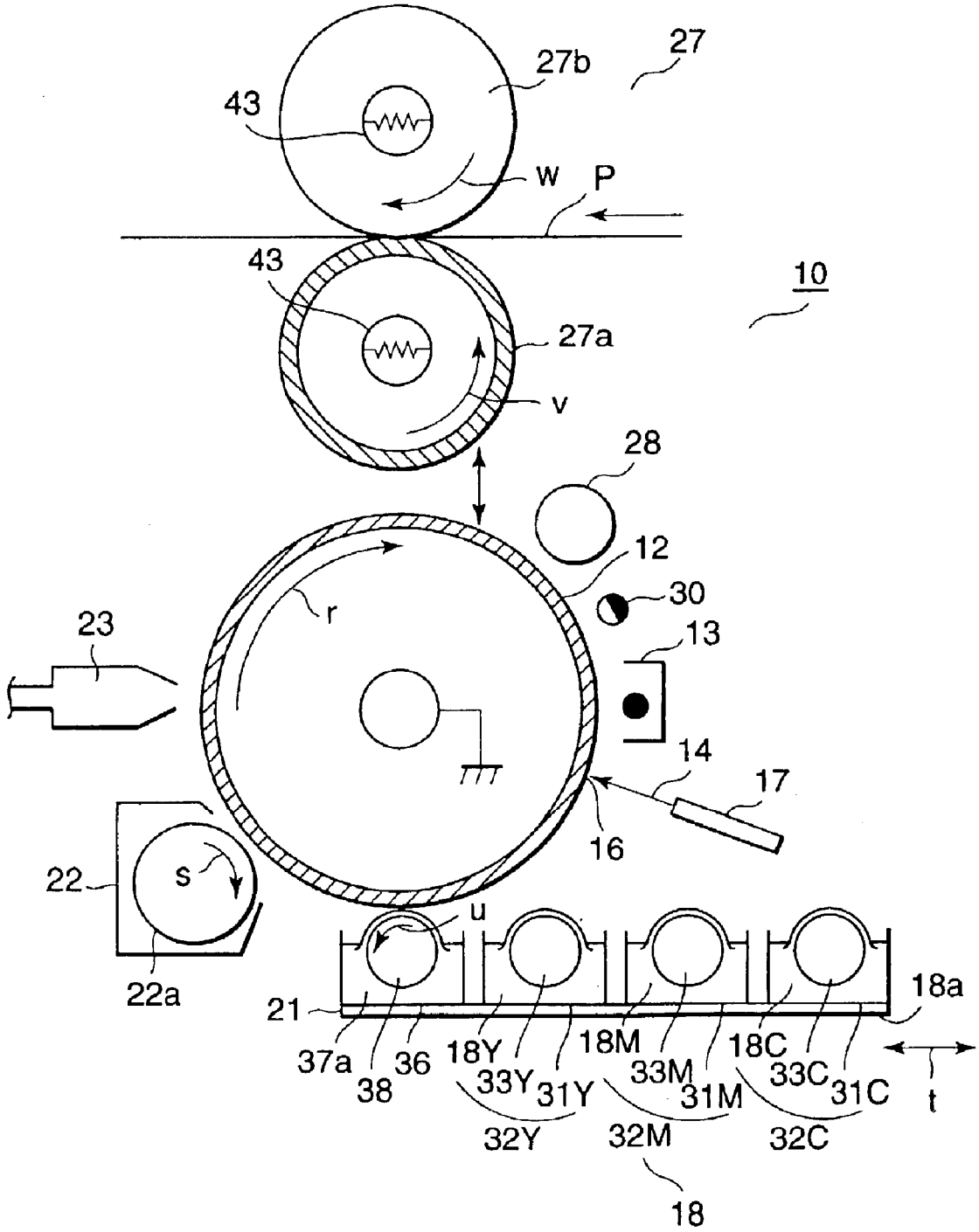
FIG. 1 is a schematic structural figure showing the image forming portion of the electrophotographic apparatus according to the first embodiment of the invention.

Embodiments of the present invention will be explained in detail referring to the attached drawings. Fist of all, the first embodiment of the invention will be described. FIG. 1 shows an image forming portion of an electrophotographic apparatus 10 as an image forming apparatus. A photosensitive drum 12, which is the image recording member, has a photosensitive layer formed with such as organic or amorphous silicon resin of 10 to 40 μm in thickness on a conductive metallic drum such as aluminum. The photosensitive drum 12 is more preferably provided with a protection layer having the thickness of 5 μm or less, which is made of such as fluorine resin, silicone resin on the photosensitive layer.

At the periphery of the photosensitive drum 12, a charger 13 including a well-known scorotron charger, an exposing device 17 for irradiating a light onto the charged photosensitive drum 12 according as the image information in order to form an electrostatic latent image on the photosensitive drum 12, and a developing unit 18 for supplying liquid developers 18Y~18C having different colors of yellow (Y), magenta (M) and cyan (C), respectively, so as to develop the electrostatic latent image are arranged along the rotational direction the photosensitive drum 12. The charger 13, the exposing device 17, and the developing unit 18 constitute the image forming apparatus.

At the periphery of the photosensitive drum 12, a transferring particle layer-forming device 21 for forming a transferring particle layer 40, a squeezing device 22 for simultaneously erasing a fog of the liquid developer image formed on the photosensitive drum 12 and removing excess liquid carrier and a dryer 23 for further removing liquid carrier again from the liquid developer image are located. Furthermore, a transferring device 27 for transferring the toner image from which liquid carrier has been thus removed, to a print paper P or a transfer medium, a cleaner 28 for cleaning remaining toner on the photosensitive drum 12 by contacting the photosensitive drum 12, and an erasing lamp 30 for erasing residual charge on the surface of the photosensitive drum 12 are arranged at downstream side of the dryer 23 on the periphery of the photosensitive drum 12

The exposing device 17 irradiates selectively a laser beam 14 corresponding to the light signal of yellow (Y), magenta (M) or cyan(C) modulated in accordance as the recording signal obtained from the image information, onto an exposing portion 16 of the photosensitive drum 12. The exposing device 17 forms an electrostatic latent image on the photosensitive drum 12 by discharging the portion of the photosensitive drum 12, where the laser beam 14 is exposed.

The developing unit 18 accommodates three developing devices 32Y~32C containing liquid developers 18Y~18C of different colors of yellow (Y),magenta (M), and cyan (C) stored in developing containers 31Y~31C respectively on a developing unit stage 18*a*. Developing rollers 33Y~33C supplying the liquid developers 18Y~18C to the surface of the photosensitive drum 12 are provide d in respective developing devices 32Y~32C. A developing bias of e.g. +600V is applied to the developing rollers 33Y~33C The developing rollers 33Y~33C are arrange to face the photosensitive drum 12 having a gap of approximately 100 μm by means of a gap roller (not shown) provided on the edge thereof. The developing unit stage 18*a* slides in reciprocal manner along the direction indicated by arrow t with a feeding mechanism, which is not shown in the figure.

The liquid developers 18Y to 18C have toner particles of diameter of approximately 1 μm or less containing at least resin component and coloring component dispersed in an insulating liquid carrier that is a dispersion solvent. The toner particles are being charged in the liquid carrier. As for the resin component of the toner particle, no limitation exists as long as the resin is insoluble to the liquid carrier. For example, acrylic resin, polyester resin, olefin resin, silicone resin, etc. are available.

With regard to the coloring components of yellow (Y), magenta (M) and-cyan (C), various dyes or pigments can be utilized. For the coloring component of yellow (Y), for example, acetoacetic acid allyl amide monoazo yellow pigment such as pigment yellow 1, ditto 3, ditto 74, ditto 97, and ditto 98, imidazolon-monoazo yellow such as pigment yellow 181, acetoacetic acid allyl amide-disazo yellow pigment such as C.I. pigment yellow 12, ditto 13, ditto 14 and ditto 17, and yellow dye such as C.I. solvent yellow 19, ditto 77, ditto 79 and C.I. disperse yellow 164 can be employed.

For the coloring component of magenta (M), for example, red or ponceau pigment such as C.I. pigment red 48, ditto 49:1, ditto 53:1, ditto 57, ditto 57:1, ditto 81, ditto 122, ditto 5 and ditto 146, and red dyes such as C.I. solvent red 49, ditto 52, ditto 58 and ditto 8 can be employed. For the coloring component of cyan (C), for example, blue dyes or pigments of cupper phthalocyanine such as C.I. pigment blue 15:3 and ditto 15:4, and derivatives thereof can be employed. In addition to these mentioned above, some additives such as charge control agent and wax can be blended if necessary.

For the embodiment mentioned above, Isoper L (produced by Exxon chemical Inc.) as the liquid carrier, positively charged acrylic resins whose glass transition temperature (hereinafter abbreviated by Tg) is 45° C., as the resin component, and pigment yellow 1, C.I. pigment red 48, and C.I. pigment blue 15:3 were utilized as the coloring components of yellow (Y), magenta (M) and cyan (C) respectively.

The-transferring particle layer-forming device 21 is located adjacent to the yellow (Y) developing device 32Y on the developing stage 18*a* of the developing unit 18. The transferring particle layer-forming device 21 accommodates liquid transferring material 37*a,* which contains transferring particles 37 dispersed in insulating dispersion solvent in a container 36, and provides a roller electrode 38 to which e.g. +400V of bias is applied, in order to supply the liquid transferring material 37*a* to the surface of the photosensitive drum 12. The roller electrode 38 faces to the photosensitive drum 12 with a gap of approximately 100 μm by means of a gap roller (not shown) provided on the edge thereof.

The transferring particles 37 are made of a resin component whose diameter is equal to or smaller than 1 μm, and are charged in the dispersion solvent. The resin component of the transferring particles 37 is set to be the same as the resin component of the toner particles. Thereby, each resin design for the transferring particles 37 and the toner particles becomes similar to each other and the designing is easily carried out. Though the transferring particles 37 do not require fundamentally any coloring agents and may be clear and colorless, some coloring agents as additive can be added thereto so as to impart releasability, etc., if necessary. As the additive, mica, magnesium oxide, alumina, zinc stearate, calcium stearate, silica, Al—Mg—Zn-hydrostearate, silicate, silicone resin, silicone rubber, silicone rubber-resin compound, zinc oxide, N-lauroyl-N-lysine, titanium oxide, etc. can be put to use.

However, materials used herein are satisfied with the following condition. That is, coagulation force of the transferring particle layer 40 formed by the transferring particles 37 that is hereinafter described as coagulation force among the transferring particles 37, should be smaller than adhesive force between the transferring particle layer 40 and the photosensitive drum 12 during pressure transferring process. In order to realize the coagulation force among the transferring particles 37 smaller, a high Tg material as a resin component of the transferring particles 37 may be used, or it may be also realized if a proper amount of the dispersion solvent remains when the liquid transferring material 37*a* is dried.

Namely, in order to cause internal breakdown easily in the transferring particle layer 40 having lower coagulation force when the surface energy difference or the shearing stress is exerted in the transferring operation, it is preferable to use the transferring particles 37 having higher Tg of the resin component. Practically, the Tg of the resin component used for the transferring particles 37 is not less than 25° C., preferably 45° C. or more. In addition, the resin component used for the toner particles of the liquid developer may have a Tg lower than that of the resin component used for the transferring particles 37, as long as internal breakdown is to be generated in the transferring particle layer 40.

On the other hand, if a proper amount of the dispersion solvent of the liquid transferring material 37*a* remains during transferring process, it is easy for the transferring particle layer 40 to generate internal breakdown when the surface energy difference or the shearing stress acts in the transferring particle layer 40.

In this embodiment, Isoper L (produced by Exxon chemical Inc.) as the dispersion solvent of the liquid transferring material 37*a,* positively charged acrylic resin whose Tg is 45° C. as the resin component, and silica as the additive were employed. A squeezing device 22 at downstream side of the transferring particle layer-forming device 21 on the periphery of the photosensitive drum 12 is provided with a metallic roller 22*a* arranged apart from the surface of the photosensitive drum 12 by approximately 50 μm. A voltage of approximately +600 V is applied to the metallic roller 22*a,* which rotated with a surface velocity about 3 times faster than the surface velocity of the photosensitive drum 12 to the direction indicated by arrow s which is same rotating direction to that of the photosensitive drum 12 denoted by the arrow r.

With regard to the liquid transferring material 37*a* supplied to the photosensitive drum 12 after having passed through the squeezing device 22, the transferring particles 37 adhered to the surface of the photosensitive drum 12 are forced to press on the photosensitive drum 12 by an electric field force. Moreover, excess dispersion solvent on the photosensitive drum 12 is removed by rotation of the metallic roller 22*a*. In the same manner, with regard to the liquid developers 18Y~18C to be supplied to the photosensitive drum 12 after having passed through the squeezing device 22, the toner particles adhered to the electrostatic latent image on the surface of the photosensitive drum 12 are forced to press on the photosensitive drum 12 by an electric field force, and toner particles existing in the background are attracted to the metallic roller side and removed simultaneously. Furthermore, excess liquid developers 18Y~18C on the photosensitive drum 12 are removed by rotation of the metallic roller 22*a*. Besides, the dryer 23 dries excess liquid carrier on the photosensitive drum 12 by blowing an air jet on the photosensitive drum 12.

As shown in FIG. 1, a transferring device 27 has an intermediate transfer roller 27*a* as an intermediate transfer medium and a press roller 27*b,* each of which has heaters 43, 43 respectively therein. The transferring device 27 transfers primarily the toner layer on the photosensitive drum 12 to the intermediate transfer roller 27*a* by the aid of transferring pressure accompanied by a shearing stress, and then transfers secondarily the toner layer to the print paper P by the aid of transferring pressure. The intermediate transfer roller 27*a* has a metallic roller whose surface is wrapped with a rubber layer, and can be separated from the photosensitive drum 12. Additionally, surface velocity V2 of the intermediate transfer roller 27*a* is designed to be a velocity lower than the surface velocity V1 of the photosensitive drum 12, i.e. 0.9V1~0.98V1, in order to give a shearing stress to the transferring particle layer 40 and the toner layer 41, thereby to improve transfer efficiency during the primary transferring.

Next, the operation of the embodiment will be described. After image forming process has started, the intermediate roller 27*a* and cleaner 28 of the transferring device 27 are separated from the photosensitive drum 12 while a full color developed image is being obtained by superimposing the transferring particle layer 40 and the toner layers 41 of yellow. (Y), magenta (M) and cyan (C) on the photosensitive drum 12. In this way, the photosensitive drum 12 starts its rotation in the direction of the arrow r while the intermediate transfer roller 27*a* and the cleaner 28 are kept separating from the photosensitive drum 12. The transferring particle layer 40 is formed firstly on the surface of the photosensitive drum 12 at the first turn of the photosensitive drum 12. Thereafter, the photosensitive drum 12 rotates by 3 turns to form tricolor toner layers 41 of yellow (Y), magenta (M) and cyan (C), by superimposing the toner layer of each color on the transferring particle layer 40 at each turn. As the result a full color developed image is obtained.

In more detail, at the first turn of the photosensitive drum 12, the developing unit stage 18*a* is slid so that the roller electrode 38 of the transferring particle layer-forming device 21 can face to the photosensitive drum 12. At the time, the developing unit 18 is held in a standby position. A gap of approximately 100 μm is provided between the surface of the photosensitive drum 12 and the roller electrode 38. The gap is filled with the liquid transferring material 37*a* as the result of the rotation of the roller electrode 38 in the direction, for example as indicated by the arrow u, and then a meniscus is formed between the photosensitive drum 12 and the roller electrode 38. Electric field is formed in the meniscus caused by the potential difference of 400V, because a bias of about +400V is applied to the roller electrode 38 while the potential of the surface of the photosensitive drum 12 is substantially 0 volt. Due to the electric field, the positively charged transferring particles 37 are electrophoresed toward the surface of the photosensitive drum 12. As a result, a coat of the liquid transferring material 37*a* containing the transferring particles 37 is formed on the entire surface of the photosensitive drum 12.

When a portion of the photosensitive drum 12 arrives at the squeezing device 22, and the metallic roller 22*a* rotating in the direction of the arrow s scrapes off excess dispersion solvent on the portion. An electric field directing from the metallic roller 22*a* to the surface of the photosensitive drum 12 is generated when the layer of the liquid transferring material 37*a* containing the transferring particles 37 on the surface of the photosensitive drum 12 comes close to the metallic roller 22*a*. In the squeezing device 22, a voltage of approximately +600V is applied to the metallic roller 22*a,* which is apart with a gap of about 50 μm from the surface of the photosensitive drum 12. The transferring particles 37 are then pressed on the surface of the photosensitive drum 12.

Furthermore, because the metallic roller 22*a* rotates in the direction of the arrow s at a velocity of about 3 times faster than the rotating velocity of the photosensitive drum 12, excess dispersion solvent existing mainly on the surface portion of the layer of the liquid transferring material 37*a* is removed by the aid of fluid squeezing effect. Next, image-forming process for yellow (Y) will start. First of all, the surface of the photosensitive drum 12 is uniformly charged up to approximately +800V by the charger 13 over the transferring particle layer 40 formed on the surface of the photosensitive drum 12. Then, a laser beam 14 of the exposing device 17 modulated with the yellow image information as the first color image information of the image information, irradiates the photosensitive drum 12 selectively to decrease the potential of the image portion to about +200V so that an electrostatic latent image corresponding to the yellow image is formed on the photosensitive drum 12.

The developing unit 18 is moved from the standby position by sliding the developing unit stage 18*a* in the direction of the arrow t, and the developing roller 33Y of yellow (Y) is moved to the developing position. The developing roller 33Y is held with a gap of approximately 100 $\mu$m to the photosensitive drum 12 at the developing position. The gap is filled with the liquid developer 18Y of yellow (Y) supplied by the developing roller 33Y and a meniscus is formed.

When the electrostatic latent image on the photosensitive drum 12 passes through the meniscus region constituted with the liquid developer 18Y of yellow (Y) between the photosensitive drum 12 and the developing roller 33Y, an electric field directing from the developing roller 33Y to the photosensitive drum 12 is formed in the image portion, whereas an electric field directing from the photosensitive drum 12 to the developing roller 33Y is formed in the non-image portion, because a voltage of approximately +600V is applied to the developing roller 33Y. Therefore, the toner particles stick only on the image portion due to the electric fields mentioned above. In consequence, an image of the liquid developer 18Y of yellow (Y), which is the first color, is formed on the photosensitive drum 12 after passing through the developing device 32Y.

In the squeezing device 22, a voltage of approximately +600V is applied to the metallic roller 22*a*. Thus an electric field directing from the surface of the photosensitive drum 12 to the metallic roller 22*a* is formed in the non-image portion, whereas, an electric field in the direction of forwarding from the metallic roller 22*a* to the photosensitive drum 12 is formed in the image portion, when the image of the liquid developer 18Y comes close to the squeezing device 22. In consequence, floating toner particles are collected by the metallic roller 22*a* in the non-image portion, whereas the toner particles constituting the image are forced to press on the surface of the photosensitive drum 12 in the image portion.

An fluid squeezing effect acted in forming the transferring particle layer 40, similarly occurs by the metallic roller 22*a,* the liquid carrier existing mainly on the surface layer portion of the liquid developer 18Y of yellow (Y) is scraped off. A thin toner layer 40 comprised of toner particles of yellow (Y) is formed on the transferring particle layer 40 on the surface of the photosensitive drum 12.

Next, image forming of magenta (M) of the second color is carried out on the toner layer 40 of yellow (Y) in the same manner as yellow (Y). Namely, at the next turn, the photosensitive drum 12 is charged and exposed, and then the developing device 32M of magenta (M) is arranged in the developing position by further sliding the developing unit stage 18*a,* so as to carry out development with the liquid developer of magenta (M). Thereafter, liquid carrier is dried and removed through the squeezing device 22 to the extent that a proper amount of liquid carrier remains, and then the toner layer 41 of magenta (M) is superimposed on the toner layer 41 of yellow (Y) on the transferring particle layer 40 of the surface of the photosensitive drum 12.

For cyan (C) of the third color, the toner layer 41 is also formed in the same manner as the above. Finally the tricolor toner layers 41 of yellow (Y), magenta (M) and cyan (C) are superimposed on the transferring particle layer 40 on the surface of the photosensitive drum 12, and a full color developed image is obtained. The full color developed image is dried with the dryer 23 and removed to the extent that a proper amount of liquid carrier remains, before transferring process is carried out. Having stacked on the surface of the photosensitive drum 12, the transferring particle layer 40 and the toner layers 41 became dray form the toner layers 41 in drying the surface of the photosensitive drum 12. Therefore, the liquid carrier remains more than in the toner layers 41, which results is decreasing the coagulation force in the transferring particle layer 40 so that internal breakdown therein is easily caused. In addition, the dryer 23 may be operated in order to remove liquid carrier further after the operation of squeezing device 22 for the three colors has been finished.

In the transferring process, the transferring device 27 and the cleaner 28 are contacted to the photosensitive drum 12. The intermediate transfer roller 27*a* is so contacted to the photosensitive drum 12 that the transferring device 27 forms a nip. The intermediate transfer roller 27*a* is driven in accordance with the rotation of the photosensitive drum 12 so that it rotates to the direction indicated by arrow v with surface velocity of approximately 0.9V1~0.98V1 when the surface velocity of the photosensitive drum 12 is V1. When the toner image formed on the transferring particle layer 40 arrives at the transfer nip between the intermediate transfer roller 27*a* and the photosensitive drum 12, the transferring particle layer 40 and the toner layers 41 are subject to receive a shearing stress caused by surface velocity differences between the intermediate transfer roller 27*a* and the photosensitive drum 12 as shown in FIGS. 2A, B.

Figure 2A:
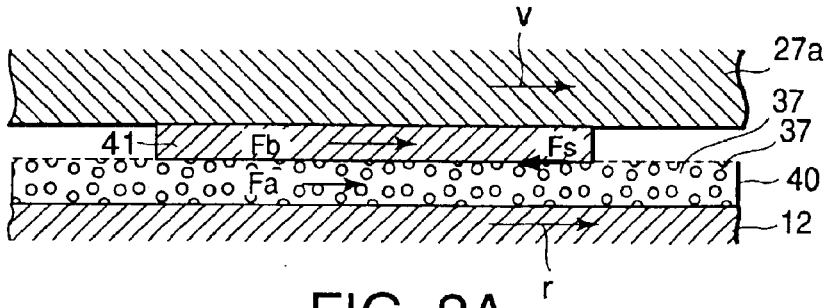
FIG. 2A is a schematic cross sectional view of the transferring particle layer and the toner layer between the photosensitive drum and the intermediate transfer roller according to the first embodiment of the invention.
Figure 2B:
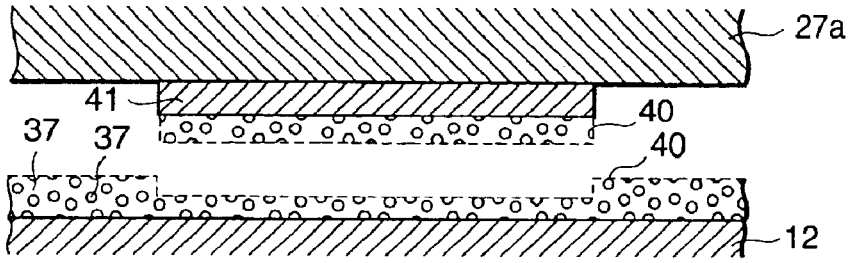
FIG. 2B is a schematic cross sectional view of the internal breakdown of the transferring particle layer according to the first embodiment of the invention.

FIG. 2A shows a schematic cross sectional view of the toner layer 41 when the intermediate transfer roller 27*a* comes to contact with the photosensitive drum 12. In the transfer nip between the intermediate transfer roller 27*a* and the photosensitive drum 12, if the shearing stress Fs, which is generated by the difference between-the surface velocity V1 of the photosensitive drum 12 and the surface velocity V2 of the intermediate transfer roller 27*a,* acts on portions between the intermediate transfer roller 27*a* and the photosensitive drum 12 and in response to the shearing stress Fs, repulsions Fb and Fa are generated in the toner layer 41 and the transferring particle layer 40, respectively. Here, because the coagulation force of the transferring particles 37 in the transferring particle layer 40 is smaller than the adhesive force between the transferring particle layer 40 and the photosensitive drum 12, the transferring particle layer 40 is defeated by the shearing stress Fs and an internal breakdown occurs in the middle part of the transferring particle layer 40 as shown in FIG. 2B.

Then the full color toner layer 41, which is pressure-contacted to the intermediate transfer roller 27*a,* is transferred primarily with high transfer efficiency to the surface of the intermediate transfer roller 27*a* together with the transferring particle layer 40. The full color toner layer 41 thus transferred primarily to the intermediate transfer roller 27*a* is transferred secondarily to the print paper P held with the intermediate transfer roller 27*a* and the pressure roller 27*b* and conveyed through. The pressure roller rotates in the direction indicated by arrow w in synchronism with the rotation of the intermediate transfer roller 27*a*. A full color developed image on the print paper P is obtained. Mechanism of the secondary transfer of the full color toner layer 41 from the intermediate transfer roller 27*a* to the print paper P relies principally on the difference of the surface energy between the intermediate transfer roller 27*a* and the print paper P.

After the full color toner layer 41 is transferred to the intermediate transfer roller 27*a,* the transferring particle layer 40 remaining on the photosensitive drum 12 is cleaned by a cleaner 28, and then residual charge thereon is erased with the erasing lamp 30. A series of image forming process finishes. Soon after the primary transferring of the full color toner layer 41, the transferring particle layers 40 were observed both on the toner layer 41 and the surface of the photosensitive drum 12 over the entire areas (100% area) thereof, and the breakdown favorably generated was confirmed.

As described above, according to the first embodiment of the present invention, being formed the transferring particle layer 40 prior to the formation of the toner layer 41 on the surface of the photosensitive drum 12, whose coagulation force among the transferring particles 37 is smaller than adhesive force to the photosensitive drum 12, when pressure-transfer of the toner layer 41 is carried out from the photosensitive drum 12 to the intermediate transfer roller 27*a* while supplying a shearing stress both to the toner layer 41 and the transferring particle layer 40, inner breakdown in the transferring particle layer 40 is generated. As a result, the toner layer 41 on the transferring particle layer 40 is surely transferred with high transfer efficiency to the intermediate transfer roller 27*a* without giving any defect in the toner layer 41, which enables to obtain a high quality developed image on the print paper P.

Furthermore, in the embodiment, no heat is applied to the photosensitive drum 12 to form the transferring particle layer 40 thereon. Accordingly, life duration of the photosensitive drum 12 is lengthened, and it becomes possible to use organic photosensitive materials which is easily affected by heat, so that room for selection of the photosensitive material is widened.

The second embodiment of the present invention will be now explained referring to FIG. 3 to FIG. 7B. In the second embodiment, the transferring particle layer formed on a predetermined region of the surface of the photosensitive drum 12 according as the pattern of a toner layer 71, instead of forming the entire surface of a photosensitive drum 12 as described in the first embodiment. Other features in the second embodiment are the same as those of the aforementioned first embodiment, so that constructions corresponding to those explained in the first embodiment are denoted by the same reference characters, and detailed explanations are not provided.

The electrophotographic apparatus of this embodiment has a pattern generating device 50 for generating image information to an exposing device 17, which sets the region on which the transferring particle layer 70 to be formed and generates a regional signal. The transferring particle layer 70 is formed on a specified region based on the regional information from the pattern generating device 50.

Figure 3:
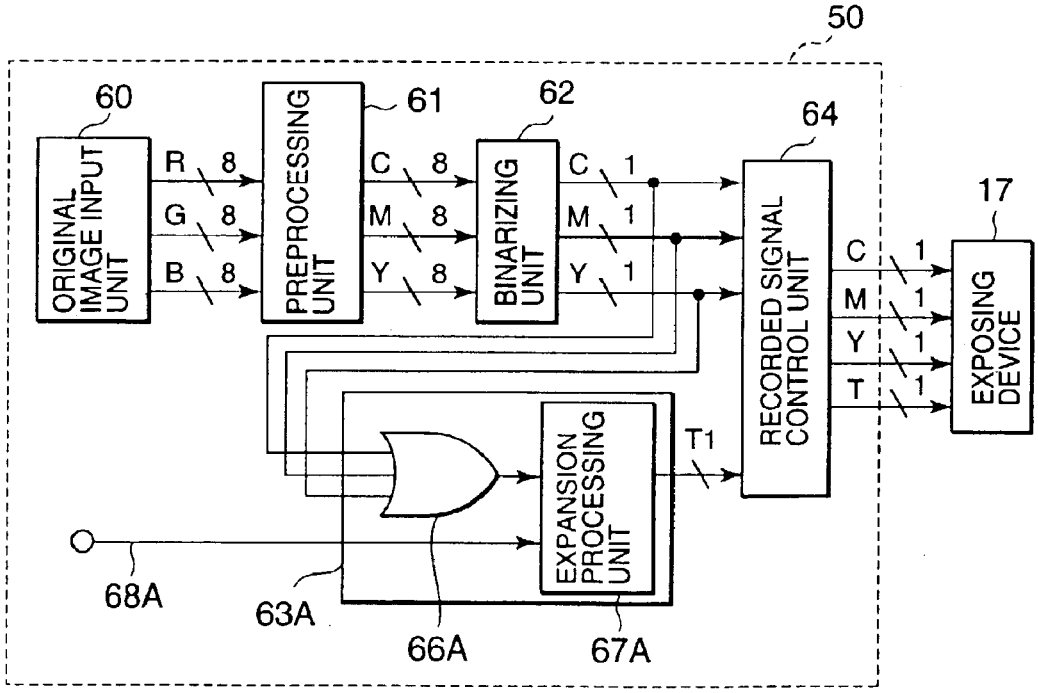
FIG. 3 is a schematic block diagram showing the pattern-generating device according to the second embodiment of the invention.

As shown in FIG. 3, the pattern generating device 50 has an original image input unit 60 adapted to receive an original image information from an input device such as a scanner or a personal computer terminal, a preprocessing unit 61 carrying out γ correction, color adjustment, and color conversion, and other processing for each 8 bit color separation signal of red (R), green (G) and blue (B) colors supplied from the original image input unit 60, and a binarizing processing unit 62 converting 8 bit image signals of yellow (Y), magenta (M) and cyan (C) derived from the preprocessing unit 61 into 1 bit image signals after carrying out the processing such as dither processing or error diffusion processing.

The pattern generating device 50 has a transferring particle layer-pattern generating unit 63A, which is a region setup device setting the region for the formation of the transferring particle layer 70. The transferring particle layer-pattern generating unit 63A includes an OR circuit 66A into which the image signals of binarized yellow (Y), magenta (M) and cyan (C) derived from the binarizing processing unit 62 are fed, and an expansion processing unit 67A expanding the signals from the OR circuit 66A. An expansion parameter signal 68A indicating how to expand is fed into the expansion processing unit 67A. In addition, the pattern generating device 50 has a recorded signal control unit 64 into which the image signals from the binarizing processing unit 62 and transferring particle layer-image T signal from the transferring particle layer-pattern generating unit 63A are fed.

Then each color information of yellow (Y), magenta (M) and cyan (C) from the recorded signal control unit 64 of the pattern generating device 50 and the regional information for the formation of the transferring particle layer 70 as modulation data of the image formed on the photosensitive drum 12, are sent to an exposing device 17, thereby a laser beam 14 is ON/OFF controlled. The image modulation data from the pattern generating device 50 enables the formation of the transferring particle layer 70 on the specified region, as well as the formation of the toner layer 71. In other words, based on the image modulation data derived from the pattern generating device 50, the transferring particle layer 70 is to be formed on the region corresponding to the toner layer 71 of the color separation images on the photosensitive drum 12 (in the case of binary, a portion having the toner layer 71 is designated by e.g. "1") and on a whole peripheral expansion region expanding from the toner layer 71 obtained through the expansion processing.

Figures 4A, 4B, 4C, 4D:
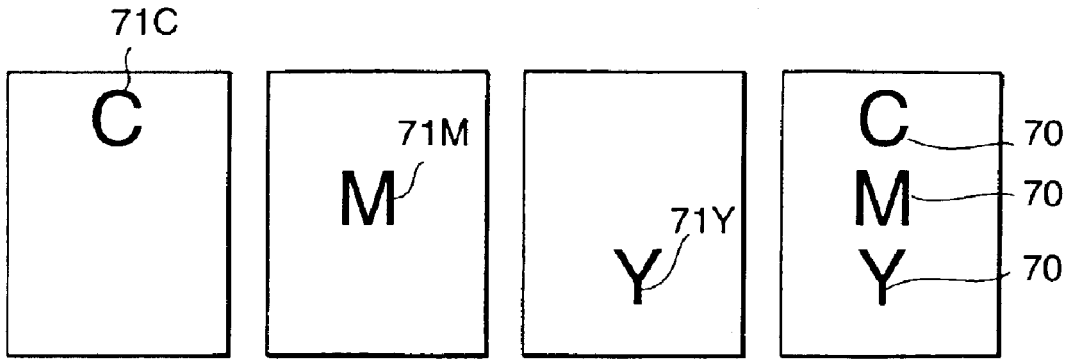
FIG. 4A is an explanatory diagram showing a pattern of the toner layer of cyan (C) according to the second embodiment of the invention.
FIG. 4B is an explanatory diagram showing a pattern of the toner layer of magenta (M) according to the second embodiment of the invention.
FIG. 4C is an explanatory diagram showing a pattern of the toner layer of yellow (Y) according to the second embodiment of the invention.
FIG. 4D is an explanatory diagram showing a pattern of the transferring particle layer according to the second embodiment of the invention.

In practice, when the color separation images are, for example, cyan (C) toner layer 71*c,* magenta (M) toner layer 71*m* and yellow (Y) toner layer 71*y* are shown in FIG. 4A, FIG. 4B, and FIG. 4C, respectively, the region for the formation of the transferring particle layer 70 has a pattern covering the entire region on which the toner layers 71*c* to 71*y* of yellow (Y), for magenta (M) and cyan (C) are formed as shown in FIG. 4D.

In general, when a full color image is formed with color separation images, misalignment among the color separation signals occurs. The misalignment between the region for the transferring particle layer 70 and the toner layer 71 may naturally occur. To complement the misalignment in this embodiment, a process to expand the region pattern for the formation of the transferring particle layer 70 is provided. The expansion processing unit 67A shown in FIG. 3 has a buffer memory for 3 lines (not shown), which expands the region pattern for the transferring particle layer 70 up to pixels 72*a* to 72*d,* located at 4 adjacent points whose coordinates are (i,j−1), (i−1,j), (i,j+1),and (i+1,j), respectively around "1" pixel 72 (i,j) constituting the toner layer 71, as designated by a black square in FIG. 5.

Figure 5:
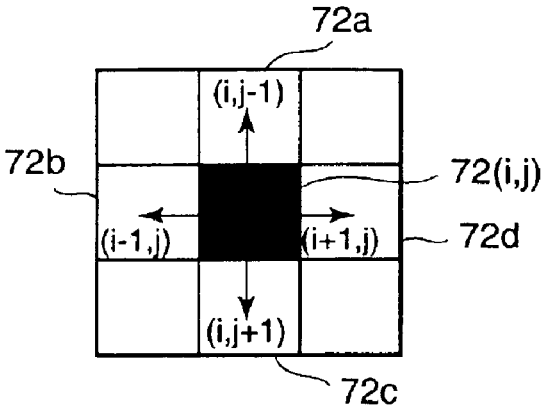
FIG. 5 is an explanatory diagram showing the expansion processing for a pixel according to the second embodiment of the invention.
Figures 6A, 6B:
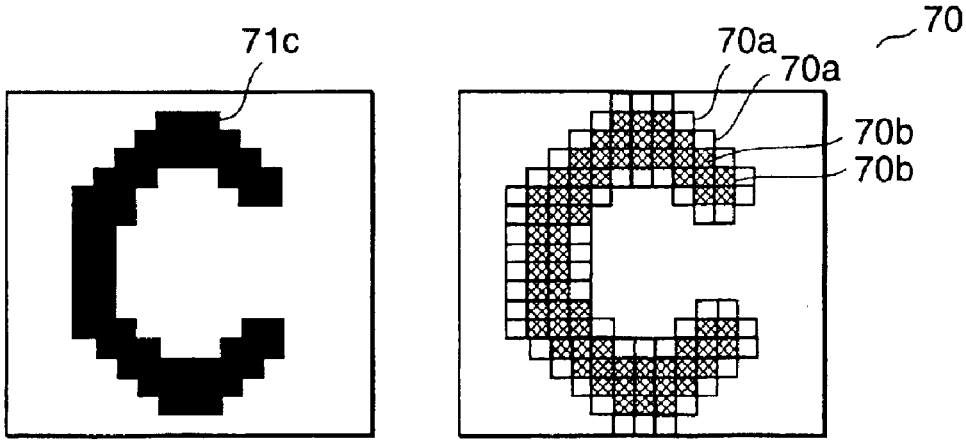
FIG. 6A is an explanatory diagram showing a pattern of the toner layer of cyan (C) according to the second embodiment of the invention.
FIG. 6B is an explanatory diagram showing a pattern of the transferring particle layer after the expansion processing according to the second embodiment of the invention.

In consequence, at the region for the cyan (C) toner layer 71*c* shown in FIG. 4A, if the expansion processing is applied to the black square of the cyan (C) toner layer 71*c* shown in FIG. 5, the region for the formation of the transferring particle layer 70 becomes the region as shown in FIG. 6B. In FIG. 6B, white squares 70*a* are the region where only the transferring particle layer 70 is formed, and crosshatched portions 70*b* designate the region where both the transferring particle layer 70 and the cyan (C) toner layer 71*c* are overlapped. By the expansion processing, the region for the transferring particle layer 70 is expanded up to the white portions 70*a* in addition to the region of the cyan (C) for toner layer 71*c*.

Moreover, the expansion degree to the toner layer 71 is adjusted by the expansion parameter signal which is fed into the expansion processing unit 67A. For example, 8-adjacence-processing that expands up to the whole pixels in 3×3 window with respect to "1" pixel (coordinate is (i,j)) constituting the toner layer 72 represented by a black square in FIG. 5 is possible, or the expansion degree within the N×N window may be possible by expanding a matrix of the periphery of "1" pixel (coordinate is (i,j)) constituting the toner layer 72 represented by the black square.

Operation of this embodiment will be described hereinafter. In this embodiment, the transferring particle layer 70 is formed on the surface of the photosensitive drum 12 before the full color image is formed in the image forming process, as is the case of the first embodiment. The forming step of the transferring particle layer 70 will be described herein after. In accordance with rotation of the photosensitive drum 12 in the direction indicated by the arrow r in response to starting of the image forming process, the surface of the photosensitive drum 12 is charged uniformly to approximately +800V by the charger 13.

Then, the photosensitive drum 12 is exposed with light from the exposing device 17 in accordance with the region pattern of the transferring particle layer 70. That is to say, the exposing device 17 exposes the ON/OFF controlled laser beam 14 based on the image modulation data transmitted from the recorded signal control unit 64 in the pattern generating device 50. The image modulation data here is information of the region for the formation of the transferring particle layer 70.

As a result, the potential at the exposed region of the surface of the photosensitive drum 12 decreases to approximately +200V, and the electrostatic latent image having the region pattern of the transferring particle layer 70 is formed on the photosensitive drum 12. Thereafter, the exposed part of the photosensitive drum 12 arrives at the transferring particle layer-forming device 21 and the roller electrode 38 supplies the liquid transferring material 37*a* thereto. Voltage of about +600V is applied to the roller electrode 38. When the electrostatic latent image passes through the meniscus region between the photosensitive drum 12 and the roller electrode 38, an electric field directing from the roller electrode 38 to the photosensitive drum 12 is formed at the region for the transferring particle layer 70 while an electric field directing from the photosensitive drum 12 to the roller electrode 38 is formed at the outside region or non-formed region for the transferring particle layer 70. Therefore the transferring particles 37 in the liquid transferring material 37*a* stick only to the region for the transferring particle layer 70.

Then, the transferring particle layer 70 on the photosensitive drum 12 arrives at the squeezing device 22, and the transferring particles 37 floating at the non-formed region of the transferring particle layer 70 are collected, while the transferring particles 37 are pressed further on the surface of the photosensitive drum 12 at the region for the transferring particle layer 70. At the same time, excess dispersion solvent on the surface of the liquid transferring material 37*a* is scraped off with the metallic roller 22*a*. Thus, the transferring particle layer 70 of the predetermined pattern according to the image modulation data from the pattern generating device 50 is formed on the surface of the photosensitive drum 12.

After the pattern of the transferring particle layer 70 is formed on the surface of the photosensitive drum 12 at the first turn of the photosensitive drum 12 in this manner, each of forming processes for the toner layers 71 of yellow (Y), magenta (M) and cyan (C) is repeated sequentially, as is the case of the first embodiment, in order to obtain the full color image in which the tricolor toner layers 71 of yellow (Y), magenta (M) and cyan (C) are superimposed. Then the dryer 23 dries and removes the liquid carrier so as to leave it moderately, and then the transferring process will start.

Figure 7A:
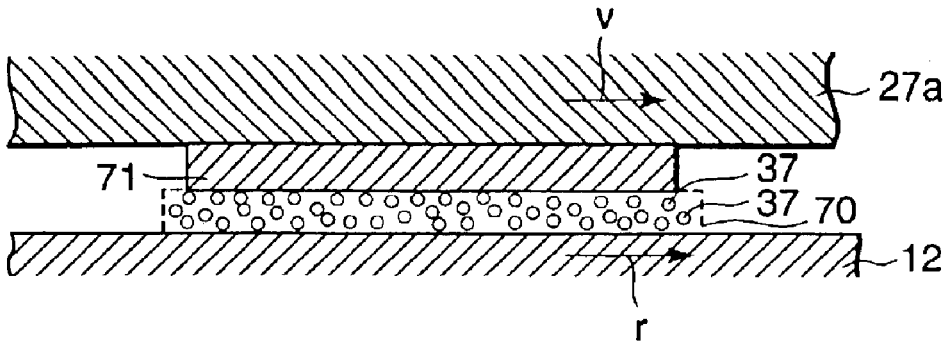
FIG. 7A is a schematic cross sectional view of the transferring particle layer and the toner layer between the photosensitive drum and the intermediate transfer roller according to the second embodiment of the invention.
Figure 7B:
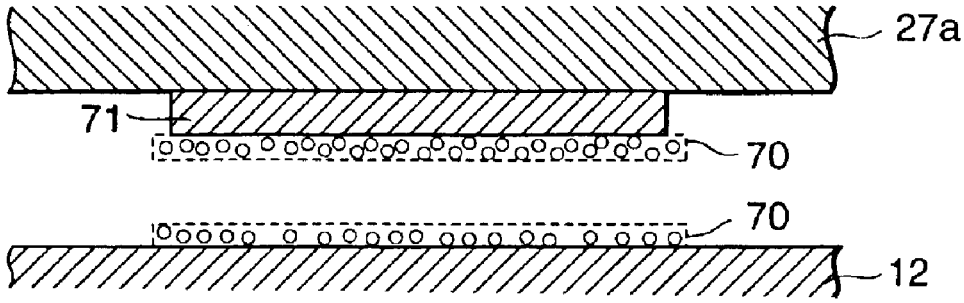
FIG. 7B is a schematic cross sectional view of the internal breakdown of the transferring particle layer according to the second embodiment of the invention.

As shown in FIG. 7A, the transferring particle layer 70 and the toner layer 71 formed on the surface of the photosensitive drum 12 in the transferring process, receive a shearing stress caused by the velocity difference between the intermediate transfer roller 27*a* and the photosensitive drum 12 when the toner layer 71 arrives at the transfer nip between the intermediate transfer roller 27*a* and the photosensitive drum 12. As shown in FIG. 7B, breakdown in the middle of the transferring particle layer 70, whose coagulation force is weaker than the adhesive force to the photosensitive drum 12 occurs by the shearing stress. The full color toner layer 71, which is pressure-contacted to the intermediate transfer roller 27*a,* is transferred primarily with high transfer efficiency to the surface of the intermediate transfer roller 27*a,* together with the transferring particle layer 70, Therefore, it is transferred secondarily to the print paper P and the full color developed image is obtained on the print paper P.

In this embodiment, as shown in FIG. 6B, if the expansion processing is applied in order to form the toner layer 71*c* shown in FIG. 6A, consumption of the transferring particles of the transferring particle layer 70 is suppressed to approximately 39% comparing to that of the transferring particle layer 70 formed on the whole surface of the photosensitive drum 12. Consumption test of the transferring particle layer 70, which is formed without the expansion processing to the toner layer 71*c* of the FIG. 6A, shows that consumption of the transferring particles of the transferring particle layer 70 could be suppressed to approximately 22% comparing to that of the transferring layer 70 formed on the whole surface of the photosensitive drum 12. The processing in this embodiment, is carried out to the binary image, however it can also be applicable to the multi-valued image.

Soon after the primary transferring of the full color layer 71 and the transferring particle layers 70, the transferring particle layers 70 were both observed on the toner layer 71 and the surface of the photosensitive drum 12 over 100 area % thereon, and the breakdown favorably generated in the inside of the transferring particle layer 70 was confirmed.

In this embodiment, as is the case of the first embodiment mentioned above, the transferring particle layer 70, which has weak coagulation force among the transferring particles 37 than the adhesive force to the photosensitive drum, is formed prior to the formation of the toner layer 71. In the primarily transferring of the toner layer 71, which is formed on the transferring particle layer 70, to the intermediate transfer roller 27*a* is carried while applying a shearing stress to both the toner layer 71 and the transferring particle layer 70, the breakdown inside portions of the transferring particle layer 70, where coagulation force among the transferring particles 37 is weak, occurs. Therefore, the toner layer 71 formed on the transferring particle layer 70 is surely transferred to the intermediate transfer roller 27*a* without any defects therein, but with high transfer efficiency, which enables to obtain a high quality developed image on the print paper P.

Furthermore, in this embodiment as is the case of the first embodiment, no heat is required to form the transferring particle layer 70 on the photosensitive drum 12 thereon. Accordingly, life duration of the photosensitive drum 12 is lengthened, and room for selection of the photosensitive material is also widened. Besides, consumption of the transferring particles of the transferring particle layer 70 is drastically suppressed because the region of the transferring particle layer 70 is limited to the region of the toner layer 71 and the expanded region in the periphery thereof, so that running cost caused by the consumption of transferring particles of the transferring particle layer 70 is suppressed. In addition, cleaning amount of remaining transferring particle layer 70 by the cleaner 28 decreases and life duration of the cleaner 28 is elongated.

The third embodiment of the present invention will be explained referring to FIG. 8 to FIG. 11B. The third embodiment is to further confine the region for the transferring particle layer in the second embodiment mentioned above. Other features are the same as those of the aforementioned second embodiment, so that the same constructions to those explained in the second embodiment are denoted by the same reference characters and detailed explanations are not provided.

An electrophotographic apparatus of this embodiment uses a pattern generating device 75, which feeds region information of the transferring particle layer to an exposing device 17 for forming the transferring particle layer only at a front edge portion of the toner layer-forming region where adhesion to a intermediate transfer roller 27*a* is small. Namely, the electrophotographic apparatus of this embodiment prevents occurrence of inferior transfer caused by the height difference between the toner layer-formed region and the non-toner layer region at the top edge portion of the toner layer.

Figure 8:
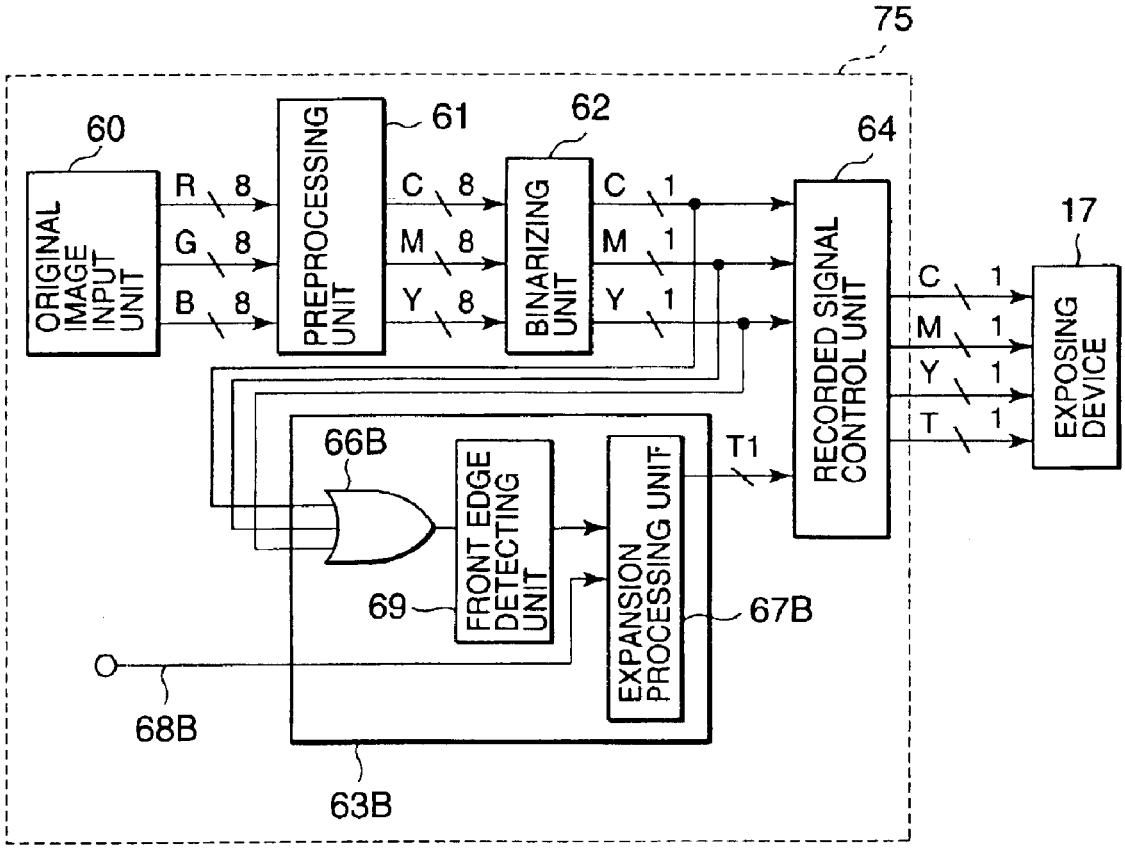
FIG. 8 is a block diagram showing the pattern-generating device according to the third embodiment of the invention.
Figure 9:
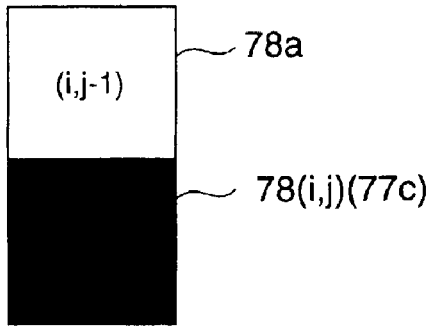
FIG. 9 is a schematic explanatory diagram showing front edge detection for a pixel according to the third embodiment of the invention.

As shown in FIG. 8, the pattern generating device 75 has a front edge detecting unit 69 between an OR circuit 66B and an expansion processing unit 67B in a transferring particle layer-pattern generating unit 63B. An expansion parameter signal 68B indicating how to expand is fed into the expansion processing unit 67B. In a front edge detecting unit 69 of the pattern generating device 75, a front edge detection is performed on image signals for yellow (Y), magenta (M) and cyan (C), which are binarized at a binarizing processing unit 62 and OR operated at an OR circuit 66B. Practically, in order for detecting the front edge, "1" pixel 78 (coordinate is (i,j)) constituting the toner layer 77*c* shown by a black square as shown in FIG. 9 is examined, for example. Then, one of the adjacent pixel 78*a* (i, j−1) is examined. In case, the pixel 78*a* (i, j−1) is "0" (toner layer 77 does not exist), then it is concluded that the pixel 78 is the front edge.

Figures 10A, 10B, 10C:
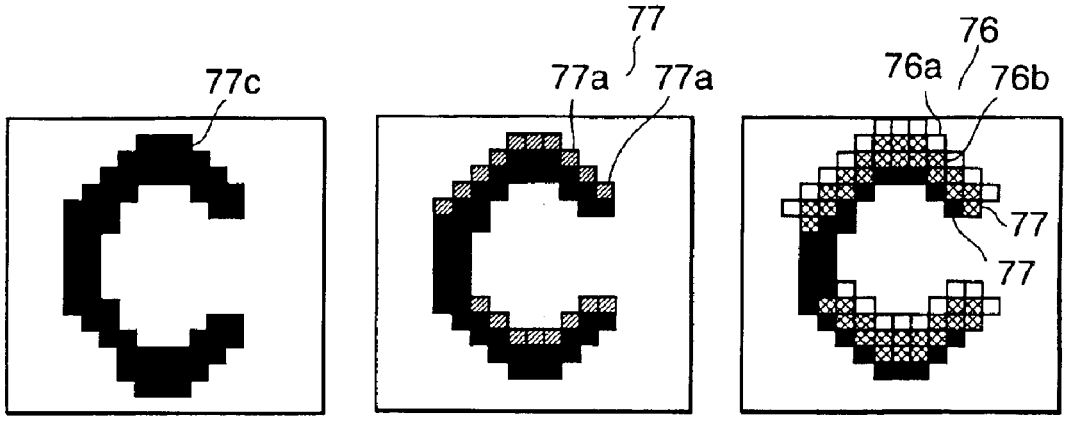
FIG. 10A is an explanatory diagram showing a pattern of the toner layer of cyan (C) according to the third embodiment of the invention.
FIG. 10B is an explanatory diagram showing a pattern of the front edge of cyan (C) toner layer according to the third embodiment of the invention.
FIG. 10C is an explanatory diagram showing a pattern of the transferring particle layer and cyan (C) toner layer after the front edge has been subjected to the expansion processing according to the third embodiment of the invention.

When such front edge detection processing is carried out to the toner layer 77*c* shown in FIG. 10A, which is the same as that shown in FIG. 6A of the second embodiment, detection result is obtained as shown in FIG. 10B. In FIG. 10B hatched square portions denote the front edge pixels 77*a*. Then, an expansion processing is carried out on the detected front edge pixels 77*a*. Content of the expansion processing is the same as the second embodiment, so that the result is shown in FIG. 10C if 4-vicinity processing is applied, for example. White squares 76*a* and crosshatched squares 76*b* in the figure are the region for the transferring particle layer 76.

In the image forming process in this embodiment, the transferring particle layer 76 is formed on the surface of the photosensitive drum 12 as is the case of the second embodiment before forming the full color image. The transferring particles 37 contains a resin component having a Tg temperature higher than the room temperature, for example about 45° C. for the transferring particles 37 while the toner particles contains similar resin component having a Tg temperature higher than the room temperature, for example about 45° C. The forming process of the transferring particle layer 76 is the same as the second embodiment except that the exposing pattern to the photosensitive drum 12 with the exposing device 17 is limited to the front edge of the toner layer 77 and its vicinity on the photosensitive drum 12.

Thereafter, the full color image is obtained by superimposing the tricolor toner layers 77 of yellow (Y), magenta (M) and cyan (C) as is the case with the second embodiment. At that time, only the front edge portion of the toner layer 77 and its vicinity are superimposed on the transferring particle layer 76.

Figure 11A:
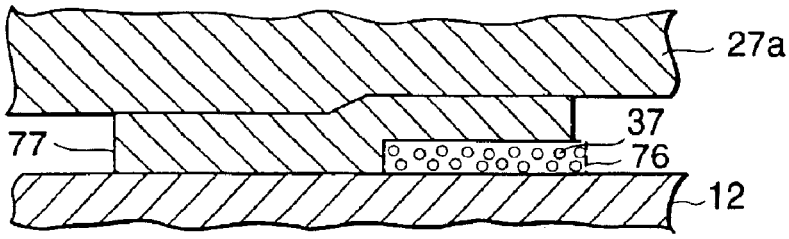
FIG. 11A is a schematic cross sectional view of the transferring particle layer and the toner layer between the photosensitive drum and the intermediate transfer roller according to the third embodiment of the invention.
Figure 11B:
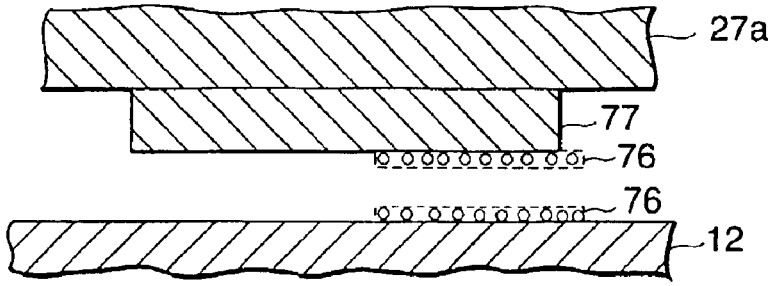
FIG. 11B is a schematic cross sectional view of the internal breakdown of the transferring particle layer according to the third embodiment of the invention.

In the transferring process, when the toner layer 77 formed on the transferring particle layer 76 arrives at the transferring nip between the intermediate transfer roller 27*a* and the photosensitive drum 12 as shown in FIG. 11A, the transferring particle layer 76 at the front edge portion of the toner layer 77, which has inferior adhesiveness to the intermediate transfer roller 27*a* breaks down in the middle thereof as shown in FIG. 11B because coagulation force among the transferring particles 37 is weaker than the adhesive force to the photosensitive drum 12. Therefore, inferior transfer is prevented in spite of poor adhesion between the toner layer 77 and the intermediate transfer roller 27*a*. Since the region of the toner layer 77 other than the front edge portion thereof has superior adhesion to the intermediate transfer roller 27*a*, the toner layer 77 is favorably transferred to the surface of the intermediate transfer roller 27*a*. Then, the toner layer 77 on the surface of the intermediate transfer roller 27*a* is transferred secondarily to the print paper P, thereby the full color developed image is obtained on the print paper P.

When the transferring particle layer 76 is formed on the region shown in FIG. 10C according to this embodiment, consumption of the transferring particles of the transferring particle layer 76 can be suppressed to approximately 20% comparing to that of transferring particle layer 76 formed on the entire surface of the photosensitive drum 12.

Soon after the primary transferring of the full color toner layer 77 and the transferring particle layers 76, the transferring particle layers 76 were observed on both surfaces of the toner layer 77 and the photosensitive drum 12 the transferred primarily to the intermediate transfer roller 27*a* and the surface of after, it was proven that remained on both surfaces of the toner layer 77 and the photosensitive drum 12 over 100 area % thereof, and breakdown was favorably generated in the inside of the transferring particle layer 76.

As constructed above, since the transferring particle layer 76 under the toner layer 77 breaks down internally at the front edge portion of the toner layer 77, inferior transfer, which is apt to occur due to deterioration of adhesion to the intermediate transfer roller 27*a*, is prevented. On the other hand, as the region of the toner layer 77 other than the front edge portion adheres favorably to the intermediate transfer roller 27*a,* transferring to the intermediate transfer roller 27*a* is favorably carried out, and the image quality is improved.

Furthermore, in the embodiment as is the case of the second embodiment, no heat is required to form the transferring particle layer 76 on the photosensitive drum 12. Accordingly, life duration of the photosensitive drum 12 is lengthened and room for selection of the photosensitive material is widened. Besides, consumption of the transferring particles of the transferring particle layer 76 can be drastically suppressed because the region of the transferring particle layer 76 is confined only to the region of the toner layers, so that running cost is saved. In addition, cleaning amount of remaining transferring particle layer 76 with the cleaner 28 decreases and life duration of the cleaner 28 is elongated.

The fourth embodiment of the present invention will be explained referring to FIG. 12 and FIG. 13B. The fourth embodiment is to regulate the thickness of the transferring particle layer in accordance with the density (thickness) of the toner layer in the third embodiment. Other features are the same as those of the aforementioned third embodiment, so that the same element portions to those explained in the third embodiment are denoted by the same reference characters and detailed explanations are not provided.

The electrophotographic apparatus according to this embodiment forms the transferring particle layer thick if the toner layer is thick and has high image density, and forms it thin if the toner layer is thin and has low image density, which then prevents occurrence of the inferior transfer caused by high image density.

Figure 12:
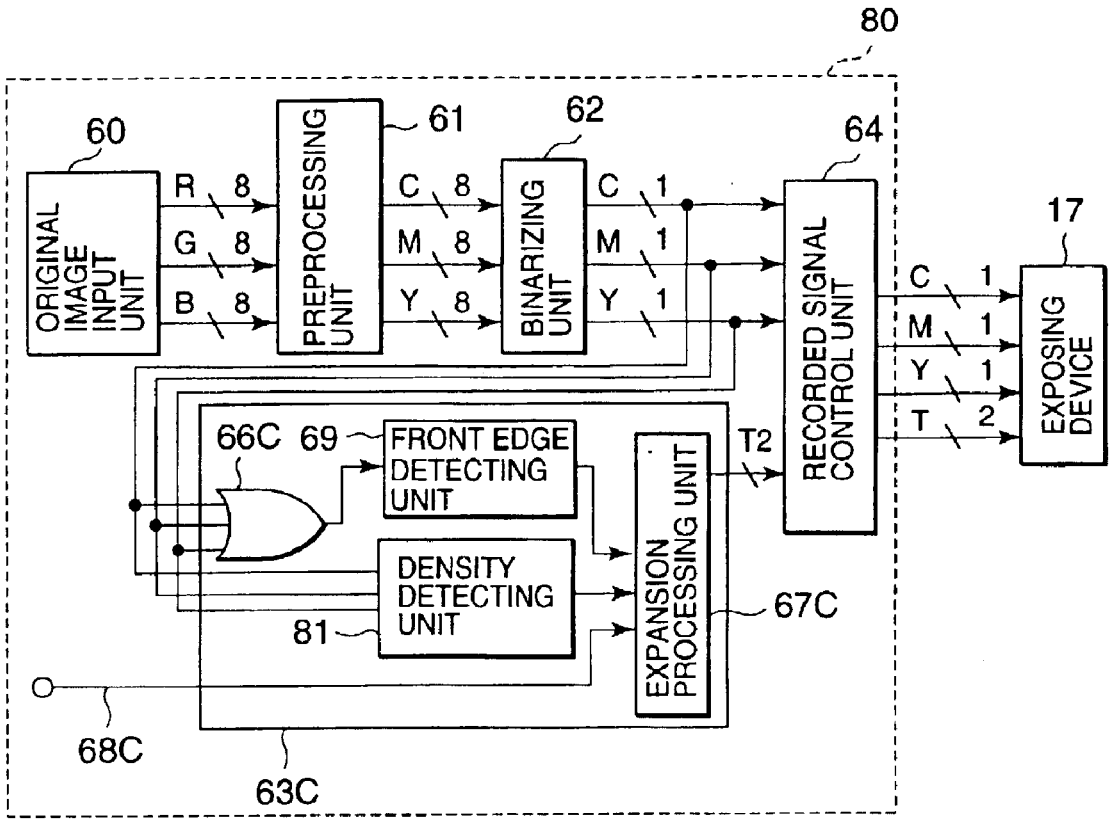
FIG. 12 is a schematic block diagram showing the pattern-generating device according to the fourth embodiment of the invention.
Figure 13A:
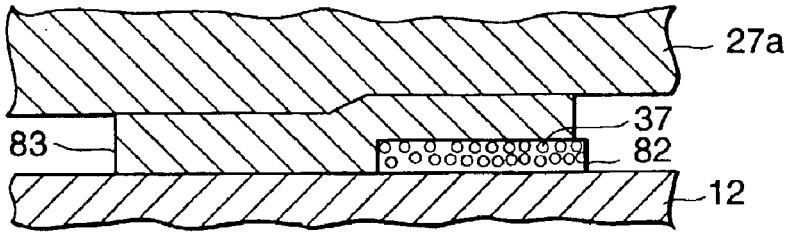
FIG. 13A is a schematic cross sectional view of the transferring particle layer and the toner layer between the photosensitive drum and the intermediate transfer roller according to the fourth embodiment of the invention.
Figure 13B:
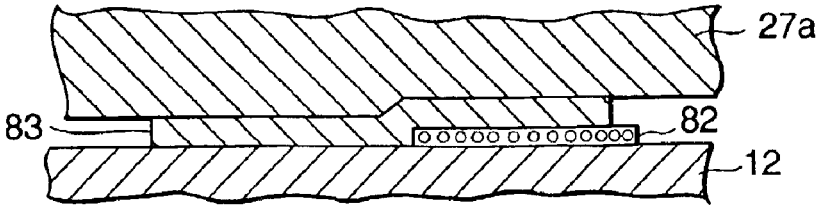
FIG. 13B is a schematic cross sectional view of the internal breakdown of the transferring particle layer according to the fourth embodiment of the invention.

As shown in FIG. 12, the pattern generating device 80 has an OR circuit 66C, an expansion processing unit 67C, a front edge detecting unit 69 and a density detecting unit 81 in the transferring particle layer-pattern generating unit 63C. An expansion parameter signal 68C indicating how to expand is fed into the expansion processing unit 67C. At the density detecting unit 81, superimposing color information according as the binarized image signals of yellow (Y), magenta (M) and cyan (C), which is derived from a binarizing processing unit 62, is obtained. Namely, the thickness of the toner layers (1 to 3 layers) to be determined by these three image signals is detected. The transferring particle layer image T signal fed to a recorded signal control unit 64 contains the exposing intensity information converted from the thickness of the aforementioned toner layers as well as the exposing pattern information to an exposing device 17 (T is 2bit in this embodiment). In the image forming process in this embodiment, a transferring particle layer 82 is formed on a surface of a photosensitive drum 12, before the full color image is formed, as is the case of the third embodiment. However the thickness of a transferring particle layer 82 is regulated by the irradiation intensity of a laser beam 14 from the exposing device 17 in accordance with the detection result of the density detecting unit 81. In consequence, the transferring particle layer 82 is made thick if the density of the toner layer 83 on the photosensitive drum 12 is high (the toner layer 83 is thick) as shown in FIG. 13A, and the transferring particle layer 82 is made thin if the density of the toner layer 83 on the photosensitive drum 12 is low (the toner layer 83 is thin) as shown in FIG. 13B.

Thereafter, the full color developed image is obtained on a print paper P via the full color image forming process and the transferring process, as is the case of the third embodiment. Because the thickness of the transferring particle layer 82 is controlled in accordance with change of the thickness of the toner layer at the transferring process, favorable transferring is achieved without inferior transfer even in the region where adhesion to the intermediate transfer roller 27*a* is small due to the thick toner layer 83.

As constructed above, in this embodiment, since the thickness of the transferring particle layer 82 is increased at the region, where inferior transfer is apt to occur due to the deterioration of adhesion to the intermediate transfer roller 27*a,* is prevented. Image quality is enhanced by the improvement of the transferability. When the transferring particle layer 82 forms thin at the region where the toner layer 83 is thin, consumption of the transferring particles for the transferring particle layer 82 is suppressed.

Furthermore, in this embodiment as is the case of the third embodiment, no heat is required to form the transferring particle layer 82 on the photosensitive drum 12. Accordingly, life duration of the photosensitive drum 12 is lengthened, and room for selection of the photosensitive material is also widened. Besides, consumption of the transferring particles for the transferring particle layer 82 is suppressed because the region for the transferring particle layer 82 is confined to only the front edge portion of the region of the toner layer 83, so that running cost can is saved. In addition, cleaning amount of remaining transferring particle layer 82 with the cleaner 28 decreases and life duration of the cleaner 28 is extended.

The fifth embodiment of the present invention will be explained referring to FIG. 14. The fifth embodiment is to regulate furthermore the pattern region of the transferring particle layer in accordance with the thickness of the toner layer in the fourth embodiment. Other feature are the same as those of the aforementioned fourth embodiment, so that the same element portions to those explained in the fourth embodiment are denoted by the same references characters and detailed explanations are not provided.

The electrophotographic apparatus according to this embodiment expands region of the transferring particle layer when the toner layer is thick and high image density, and narrows it when the toner layer is thin and has low image density, which thus prevents occurrence of the inferior transfer due to high image density.

Figure 14:
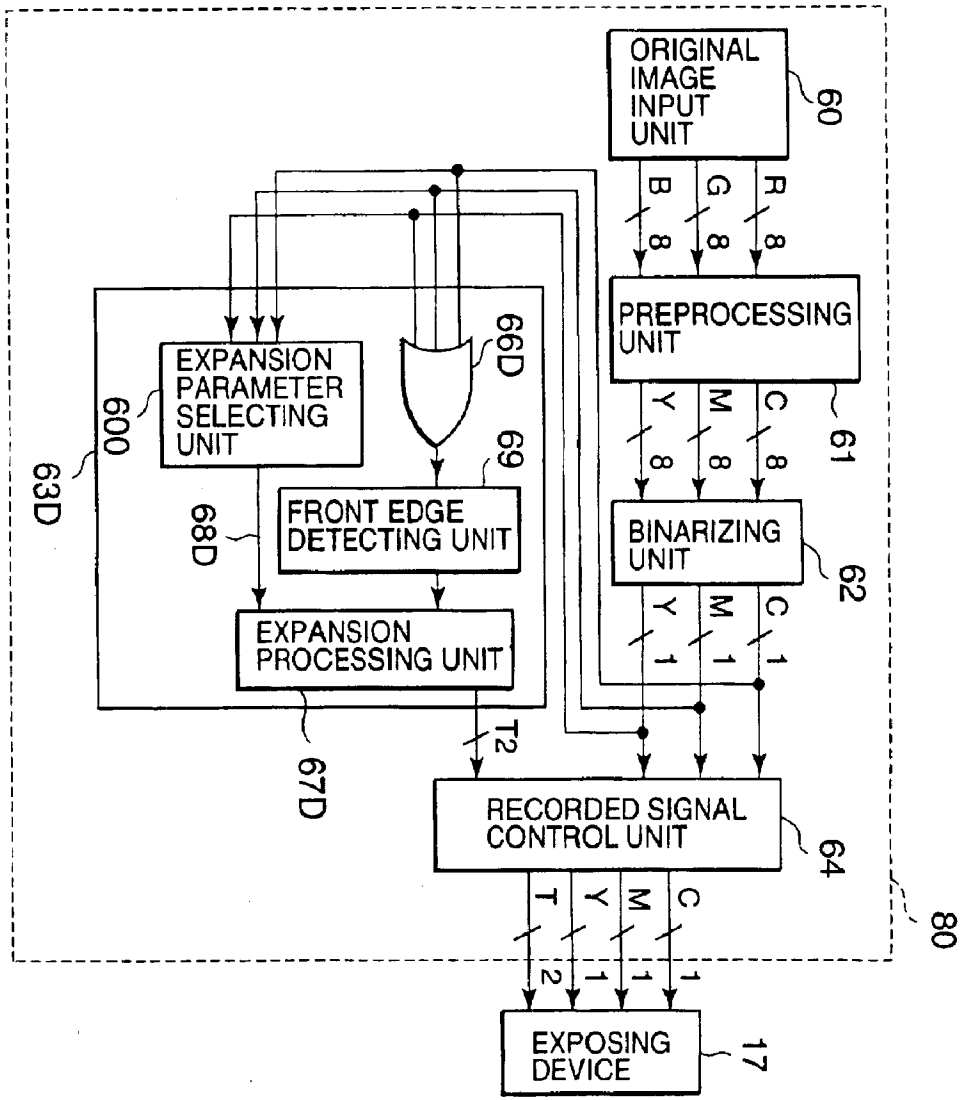
FIG. 14 is a schematic block diagram showing the pattern-generating device according to the fifth embodiment of the invention.

As shown in FIG. 14, the pattern generating device 80 has an OR circuit 66D, an expansion processing unit 67D, the front edge detecting unit 69 and an expansion parameter selecting unit 600 in a transferring particle layer-pattern generating unit 63D. At the expansion parameter selecting unit 600 in the pattern generating device 80, superimposing color information according as the binarized image signals of yellow (Y), magenta (M) and cyan (C) derived from the binarizing processing unit 62 is obtained. Namely, the thickness of the toner layer (1 to 3 layers) to be formed by three image signals is detected. The expansion parameter is selected from such thickness information.

For example, 4-vicinity processing is selected if the toner layer is thin (1 layer), and 8-vicinity processing is selected if the toner layer is thick (2 to 3 layers). The information for such a binary processing is fed as the expansion parameter signal to the expansion processing portion, and expansion processing of the region in accordance with the expansion parameter is carried out.

In this embodiment, the transferring particle layer (not shown) is formed on a surface of a photosensitive drum 12 before the full color image is formed at the image forming process, as is the case of the third embodiment. However the region for the transferring particle layer is regulated by the irradiation region of a laser beam 14 by an exposing device 17, in accordance with the information derived from the expansion processing unit 67D. In consequence, the transferring particle layer is formed on a widen region including the image forming region and 8 vicinity regions thereof when the toner layer on the photosensitive drum 12 is thick, and the transferring particle layer is formed on a narrowed region including the image forming region and 4 vicinity regions thereof when the toner layer is thin.

Thereafter, the full color developed image is obtained on a print paper P via the full color image forming process and the transferring process, as is the case of the third embodiment. Because the thickness of the transferring particle layer is controlled in accordance with change of the thickness of the toner layer at the transferring process, favorable transferring is achieved without inferior transfer even in the region where adhesion to a intermediate transfer roller 27*a* is small due to the thick toner layer.

According to this embodiment, the forming region of the transferring particle layer is so widened at the portion, where the toner layer is thick, that inferior transfer caused by deterioration of adhesion to the intermediate transfer roller 27*a* is prevented. Quality of image is enhanced due to the improvement of the transferability. On the other hand, when the region for the transferring particle layer forms narrow at the region where a toner layer 83 is thin, consumption of the transferring particles of the transferring particle layer 82 is suppressed by making.

Furthermore, in this embodiment as is the case of the third embodiment, no heat is required to form the transferring particle layer 82 on the photo the photosensitive drum 12. Accordingly, life duration of the photosensitive drum 12 is lengthened, so that room for selection of the photosensitive material is widened. Besides, consumption of the transferring particles of the transferring particle layer 82 is suppressed because the region of the transferring particle layer 82 is confined only to the front edge portion of the region for the toner layers, so that running cost is saved. In addition, cleaning amount of remaining transferring particle layer with a cleaner 28 decreases and life duration of the cleaner 28 is elongated.

The present invention is not limited to the embodiments mentioned above, but many changes and modifications can, of course, be carried out without departing from the scope of the present invention. For example, the structure and the process of the image forming apparatus are not limited to the aforementioned features. Color of the developer used for the developing process is not limited to three colors, but it is arbitrary. It may be one or two colors. Developing with 4 colors or more is also possible. Materials for the developer and the transferring particles are not limited as long as the coagulation force among the transferring particles in the transferring particle layer does not exceed the adhesive force between the transferring particle layer and the photosensitive drum. The transferring particle may be clear, colorless, or colored moderately. With respect to the material, for the intermediate transfer medium and the image recording member, they are freely selected if favorable transferring or image forming properties are obtained.

In order to realize that remaining rates of the transferring particle layer on the image recording member and the toner layer are both 100 area % of the area of the transferring layer after the toner layer is transferred to the medium, the coagulation force among the transferring particles of the transferring particle layer is preferably enough to cause the breakdown in the inside of the transferring particle layer. The coagulation force among the transferring particles of the transferring particle layer is not limited to the above, but may be any coagulation force satisfying the remaining rates of the transferring particle layer on both the image recording member and the toner layer being approximately 90 area % over the area of the transferring particle layer after the toner layer is transferred to the medium to be transferred to.

Moreover the resin component of the transferring particle is not necessarily one kind, but it may include. In that case, the same effects to those mentioned above will be expected as long as the Tg of at least one kind of resin is not less than 25° C., preferably it is not less than 45° C. Furthermore, the transferring particle can be constituted only with the materials, which are used as the additives shown in the embodiments mentioned above. Namely, the transferring particle constituted with a metal oxide such as $SiO_2$, $TiO_2$, $SnO_2$, and ZnO, may have the same performance.

In addition, the transfer device can naturally be any device that does not add any shearing stress as long as it is a pressure transferring type. Because the coagulation force among the transferring particles of the transferring particle layer is weak, inner breakdown occurs in the transferring particle layer even if the transfer process, which utilizes only the difference of surface energy is applied. The toner layer is then prevented from remaining on the image recording member, thereby a high transfer efficiency is obtained.

Figure 15:
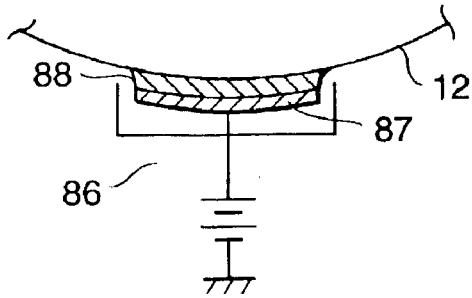
FIG. 15 is a schematic structural figure showing a transferring particle layer-forming device of another variation.

The structure of the transferring particle-forming device forming the transferring particle layer on the image recording member is also not limited to the embodiments mentioned above. For example, when the transferring particle layer is formed electrostatically on a photosensitive drum 12, as done in the first embodiment, instead of using the roller electrode, a fixed disc electrode 87 which applies a bias potential to a transferring particle layer-forming device 86 is used as a variation as shown in FIG. 15.

Moreover in the third embodiment for example, detecting method of the front edge of the toner layer 77 is arbitrary, and any general detecting device such as Sobel Operator can be available. Regulation of the layer thickness of the transferring particle layer 82 in accordance with the thickness of the toner layer 83 in the fourth embodiment may be freely applicable to the first embodiment, the second embodiment, or other embodiments.

According to the present invention as described hitherto in detail, transfer efficiency of the toner layer is drastically improved by forming the transferring particle layer before forming the toner layer on the surface of the image recording member and by making the coagulation force among the transferring particles in the transferring particle-layer be smaller than the adhesive force between the transferring particle layer and the image recording member. Therefore a high quality transferred image due to high transfer efficiency can be obtained, and an image forming apparatus which realizes high image quality is provided. Furthermore, the image recording member are not affected by heat when the transferring particle layer is formed, life duration of the image recording member is lengthened, and room for selection of the photosensitive material becomes wide.

What is claimed is:

1. An image forming apparatus comprising:

an image recording member;

a transferring particle layer forming equipment which forms a transferring particle layer on at least a part of the image recording member;

a development equipment which forms at least a part of a toner layer with toner particles on a surface of the transferring particle layer according to image information and with a liquid developer containing the toner particles and a liquid carrier in a manner that the toner layer is superimposed on the transferring particle layer; and a transfer equipment which divides the transferring particle layer into a first layer adjacent to the toner layer and a second layer adjacent to the image recording member, the transfer equipment transferring the toner layer to a transfer medium together with the first layer of the transferring particle layer while the second layer of the transferring particle layer remains on the image recording member, wherein a coagulation force among transferring particles in the transferring particle layer is smaller than an adhesive force of the transferring particle layer to the image recording member.

2. The image forming apparatus as stated in claim 1, wherein Tg (glass transition temperature) of the transferring particles is not less than 25 decrees Celsius.

3. The image forming apparatus as stated in claim 1, wherein the transfer equipment includes an intermediate transfer medium, wherein the toner layer and the transferring particle layer are primarily transferred to the intermediate transfer medium, and the primarily transferred toner layer is secondarily transferred to the transfer medium with a part of the transferring particle layer on the intermediate transfer medium.

4. The image forming apparatus as stated in claim 3, wherein the intermediate transfer medium applies a shearing stress to both the toner layer and the transferring particle layer formed on the image recording member.

5. The image forming apparatus as stated in claim 1, further comprising a pattern generating unit configured to set a regional pattern for forming the transferring particle layer.

6. The image forming apparatus as stated in claim 5, wherein the pattern generating unit includes a front edge detecting unit configured to detect a front edge of the image information, and sets a regional pattern for forming the transferring particle layer in accordance with the detected front edge.

7. The image forming apparatus as stated in claim 1, wherein the image forming apparatus further comprises a density detecting unit configured to detect a density of the toner layer; and a layer thickness-controlling unit configured to control a layer thickness of the transferring particle layer in accordance with the detection result fed from the density detecting unit.

8. An image forming apparatus comprising:

an image recording member;

a transferring particle layer forming equipment which forms a transferring particle layer on at least a part of the image recording member;

a development equipment which forms at least a part of a toner layer with toner particles on a surface of the transferring particle layer according to image information and with a liquid developer containing the toner particles and a liquid carrier in a manner that the toner layer is superimposed on the transferring particle layer; and a transfer equipment which divides the transferring particle layer into a first layer adjacent to the toner layer and a second layer adjacent to the image recording member, the transfer equipment transferring the toner layer to a transfer medium together with the first layer of the transferring particle layer while the second layer of the transferring particle layer remains on the image recording member, wherein transferring particles in the first layer of the transferring particle layer on the toner layer and in the second layer of the transferring particle layer on the image recording member cover approximately not less than 90% of a whole area of the toner layer and the image recording member, respectively.

9. The image forming apparatus as stated in claim 8, wherein the transferring particles comprise a resin whose Tg is not less than 25 degrees Celsius.

10. The image forming apparatus as stated in claim 8, wherein the transfer equipment includes an intermediate transfer medium, wherein the toner layer and the transferring particle layer are primarily transferred to the intermediate transfer medium, and the primarily transferred toner layer is secondarily transferred to the transfer medium with a part of the transferring particle layer on the intermediate transfer medium.

11. The image forming apparatus as stated in claim 10, wherein the intermediate transfer medium applies a shearing stress to both the toner layer and the transferring particle layer formed on the image recording member.

12. The image forming apparatus as stated in claim 8, further comprising a pattern generating unit configured to set a regional pattern for forming the transferring particle layer.

13. The image forming apparatus as stated in claim 12, wherein the pattern generating unit includes a front edge detecting unit configured to detect a front edge of the image information, and sets a regional pattern for forming the transferring particle layer in accordance with the detected front edge.

14. The image forming apparatus as stated in claim 8, wherein the image forming apparatus further comprises a density detecting unit configured to detect a density of the toner layer; and a layer thickness-controlling unit configured to control a layer thickness of the transferring particle layer in accordance with the detection result fed from the density detecting unit.

15. An image forming method comprising:

forming a transferring particle layer with transferring particles, whose coagulation force among themselves is smaller than an adhesion force thereof to an image recording member, on at least a part of the image recording member;

forming at least a part of a toner layer with toner particles on a surface of the transferring particle layer according to image information and with a liquid developer containing the toner particles and a liquid carrier in a manner that at least a part of the toner layer is superimposed on the transferring particle layer;

dividing the transferring particle layer into a first layer adjacent to the toner layer and a second layer adjacent to the image recording member; and transferring the toner layer from the image recording member to a transfer medium together with the first layer of the transferring particle layer while the second layer of the transferring particle layer remains on the image recording member.

16. The image forming method as stated in claim 15, wherein the transferring particles comprise a resin whose Tg is not less than 25 decrees Celsius.

17. The image forming method as stated in claim 16, wherein the transferring step comprises a primary transferring step for transferring the toner layer from the image recording member to an intermediate transfer medium and a secondary transferring step for transferring the toner layer transferred to the intermediate transfer medium to the transfer medium.

18. An image forming method comprising:

forming a transferring particle layer of transferring particles on at least a part of an image recording member;

forming at least a part of a toner layer with toner particles on a surface of the transferring particle layer according to image information and with a liquid developer containing the toner particles and a liquid carrier in a manner that at least a part of the toner layer is superimposed on the transferring particle layer;

dividing the transferring particle layer into a first layer adjacent to the toner layer and a second layer adjacent to the image recording member; and transferring the toner layer from the image recording member to a transfer medium together with the first layer of the transferring particle layer while the second layer of the transferring particle layer remains on the image recording member, wherein the transferring particles in the first layer of the transferring particle layer on the toner layer and in the second layer of the transferring particle layer on the image recording member cover approximately not less than 90% of a whole area of the toner layer and the image recording member, respectively, when the transferring step has finished.

19. The image forming method as stated in claim 18, wherein the transferring particles comprise a resin whose Tg is not less than 25 degrees Celsius.

20. The image forming method as stated in claim 18, wherein the transferring step comprises a primary transferring step for transferring the toner layer from the image recording member to an intermediate transfer medium and a secondary transferring step for transferring the toner layer transferred to the intermediate transfer medium to the transfer medium.

* * * * *